US006664211B2

(12) United States Patent
Loccufier et al.

(10) Patent No.: US 6,664,211 B2
(45) Date of Patent: Dec. 16, 2003

(54) THERMOGRAPHIC RECORDING MATERIAL WITH IMPROVED IMAGE TONE

(75) Inventors: Johan Loccufier, Zwijnaarde (BE); Ivan Hoogmartens, Wilrijk (BE)

(73) Assignee: Agfa-Gevaert (BE)

( * ) Notice: Subject to any disclaimer, the term of this patent is extended or adjusted under 35 U.S.C. 154(b) by 96 days.

(21) Appl. No.: 09/997,576

(22) Filed: Nov. 29, 2001

(65) Prior Publication Data

US 2002/0123426 A1 Sep. 5, 2002

Related U.S. Application Data

(60) Provisional application No. 60/257,230, filed on Dec. 21, 2000.

(30) Foreign Application Priority Data

Nov. 30, 2000 (EP) ..... 00204255

(51) Int. Cl.[7] ..... B41M 5/30
(52) U.S. Cl. ..... 503/201; 503/209; 503/212
(58) Field of Search ..... 503/201, 212, 503/208, 209

(56) References Cited

U.S. PATENT DOCUMENTS

| | | | |
|---|---|---|---|
| 3,218,166 | A | 11/1965 | Reitter |
| 3,547,648 | A | 12/1970 | Sagawa |
| 4,013,473 | A | 3/1977 | Willems et al. |
| 5,672,560 | A | 9/1997 | Rush |

FOREIGN PATENT DOCUMENTS

| | | |
|---|---|---|
| GB | 1410991 | 10/1975 |
| WO | WO 97/11407 | 3/1997 |
| WO | WO 97/34196 | 9/1997 |

*Primary Examiner*—B. Hamilton Hess
(74) *Attorney, Agent, or Firm*—Leydig Voit & Mayer, Ltd.

(57) ABSTRACT

A substantially light-insensitive black and white thermographic recording material comprising a support and a thermosensitive element exclusive of bisphenol compounds, 4-substituted isoxazole compounds of the formula wherein R represents an aromatic group or an electron withdrawing group, organic compounds represented by $R^3$—H, the corresponding radical of which, $R^{3\bullet}$, has a stability of from 350 to 6000 times that of a primary alkyl radical, and photosensitive active-hydrogen aromatic organic reducing agents, the thermosensitive element containing at least one substantially light-insensitive organic silver salt, an organic reducing agent therefor in thermal working relationship therewith, an image tone stabilizer and a binder, characterized in that the image tone stabilizer is a sterically hindered monophenol; a recording process therefor; and the use of a sterically hindered monophenol in a substantially light-insensitive thermographic recording material as an image tone stabilizer.

9 Claims, No Drawings

THERMOGRAPHIC RECORDING MATERIAL WITH IMPROVED IMAGE TONE

CROSS-REFERENCE TO RELATED PATENT APPLICATIONS

This application claims the benefit of U.S. Provisional Application No. 60/257,230 filed Dec. 21, 2000, which is incorporated by reference. In addition, this application claims the benefit of European Application No. 00204255.4 filed Nov. 30, 2000, which is also incorporated by reference.

FIELD OF THE INVENTION

The present invention relates to thermographic recording materials whose prints have improved shelf-life image tone stability.

BACKGROUND OF THE INVENTION

Thermal imaging or thermography is a recording process wherein images are generated by the use of thermal energy. In direct thermal thermography a visible image pattern is formed by image-wise heating of a recording material.

U.S. Pat. No. 3,218,166 discloses a heat-sensitive copy sheet product capable of providing high contrast dense black images on a white background when briefly heated at image areas to conversion temperature within the approximate range of 90–150° C., said product containing, uniformly applied over a paperlike carrier and in position for heat-induced inter-reaction, reactants comprising a silver soap of an organic acid, a toner for the silver image, a di-tertiaryalkyl substituted phenol first reducing agent for the silver ion in an amount of at least about 0.01 mol per mol of silver soap and insufficient to form with said silver soap a dense image when briefly heated therewith, and a photosensitive different active-hydrogen aromatic organic second reducing agent for said silver ion in an amount no greater than that of said first reducing agent, said first reducing agent being further characterized as forming with an equal weight of silver behenate and one-fifth said weight of phthalazinone a uniformly blended trace deposit requiring at least six seconds preheat at 100° C., before rapidly darkening at that temperature, and said second reducing agent on exposure to actinic radiation being rendered incapable of reducing silver ion on briefly heating with silver soap at 150° C.

U.S. Pat. No. 3,547,648 discloses sheet material in copying processes, including a reactant layer comprising a silver soap of an organic acid, a tertiary-alkyl-substituted monophenol, and a tertiaryalkyl-substituted bisphenol, said substituted phenols each being a reducing agent for the silver ion and being characterized as forming with an equal weight of silver behenate and one fifth said weight of phthalazinone a uniformly blended trace deposit requiring at least six seconds preheat at 100° C. before rapidly darkening at that temperature.

WO 97/34196 discloses a black and white thermographic element comprising a support bearing at least one, image-forming, thermographic emulsion layer comprising: (a) a non-photosensitive, reducible silver source; (b) a reducing agent system for silver ion; and (c) a binder; wherein said reducing agent system comprises: (i) at least one hindered phenol; and (ii) at least one co-developer of the formula

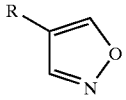

wherein: R represents an aromatic group or an electron withdrawing group.

A thermographic element comprising a support bearing a support bearing at least one image-forming, thermographic emulsion layer comprising: (a) a non-photosensitive, reducible silver source; (b) a reducing agent system for said non-photosensitive, reducible silver source; and (c) a binder; wherein said reducing agent system comprises: (i) at least one hindered phenol; (ii) at least one co-developer of the formula $R^1$—(C=O)—NHNH—$R^2$ wherein $R^1$ represents hydrogen and $R^2$ represents an aryl group; or, $R^1$ represents hydrogen, alkyl or alkenyl of 1 to 20 carbon atoms; aryl, alkaryl, or aralkyl groups of up to 20 carbon atoms; aryloxy, thioaryloxy, or anilino groups of up to 20 carbon atoms; aliphatic or aromatic heterocyclic ring groups containing up to 6 ring atoms; carboxylic ring groups comprising up to 6 ring carbon atoms; or fused ring or bridging groups comprising up to 14 ring atoms; and $R^2$ represents a trityl group; and (iii) at least one hydrogen atom donor compound of the formula: $R^3$—H wherein $R^3$—H represents an organic compound, the corresponding radical of which, $R^{3\bullet}$, has a stability of from 350 to 6000 times that of a primary alkyl radical.

In printing with thermographic materials for medical applications for viewing with a light box, optimum diagnosis requires a blue-black image tone so that the higher ability of the human eye to distinguish detail with such image tone can be exploited, thereby improving the diagnostic value of such prints. Such image tone should be independent of the shelf-life of the thermographic recording material prior to printing and also of archival time after printing. Image tone can be assessed on the basis of the L*, a* and b* CIELAB-values as determined by spectrophotometric measurements according to ASTM Norm E179-90 in a R(45/0) geometry with evaluation according to ASTM Norm E308-90. Ingredients are required for substantially light-insensitive thermographic recording materials, which provide a balance of image tone stabilizing properties, enabling prints to be obtained with image tone which after pretempering is less dependent upon storage time prior to printing and to archival time after printing, while exhibiting image tone acceptable for radiologists viewing images in transmission on a light box.

It is therefore an aspect of the present invention to provide substantially light-insensitive black and white thermographic recording materials with improved image tone stability not only capable of producing prints with image tone which is less dependent upon storage time prior to printing.

Further objects and advantages of the invention will become apparent from the description hereinafter.

BRIEF SUMMARY OF THE INVENTION

It has been surprisingly found that substantially light-insensitive thermographic recording materials comprising a thermosensitive element containing sterically hindered monophenols are capable of providing prints whose image tone is less dependent upon storage time prior to printing than prior art materials substantially light-insensitive thermographic recording materials.

Aspects of the present invention are provided by a substantially light-insensitive black and white thermographic recording material comprising a support and a thermosensitive element exclusive of bisphenol compounds, 4-substituted isoxazole compounds of the formula

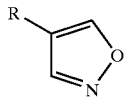

wherein R represents an aromatic group or an electron withdrawing group, organic compounds represented by $R^3$—H, the corresponding radical of which, $R^{3\bullet}$, has a stability of from 350 to 6000 times that of a primary alkyl radical, and photosensitive active-hydrogen aromatic organic reducing agents, the thermosensitive element containing at least one substantially light-insensitive organic silver salt, an organic reducing agent therefor in thermal working relationship therewith, an image tone stabilizer and a binder, characterized in that the image tone stabilizer is a sterically hindered monophenol.

Aspects of the present invention are also provided by a recording process comprising the steps of: (i) bringing an outermost layer of a thermographic recording material as described above into proximity with a heat source; (ii) applying heat from the heat source imagewise to the thermographic recording material in a substantially water-free condition while maintaining proximity to the heat source to produce an image; and (iii) removing the thermographic recording material from the heat source.

Use of a sterically hindered monophenol in a substantially light-insensitive thermographic recording material as an image tone stabilizer is also provided by the present invention.

Further advantages and embodiments of the present invention will become apparent from the following description.

DETAILED DESCRIPTION OF THE INVENTION

According to a first aspect of the thermographic recording process, according to the present invention, the heat source is a thermal head.

According to a second aspect of the thermographic recording process, according to the present invention, the heat source is a thin film thermal head.

The term alkyl means all variants possible for each number of carbon atoms in the alkyl group i.e. for three carbon atoms: n-propyl and isopropyl; for four carbon atoms: n-butyl, isobutyl and tertiary-butyl; for five carbon atoms: n-pentyl, 1,1-dimethyl-propyl, 2,2-dimethylpropyl and 2-methyl-butyl etc.

By substantially light-insensitive is meant not intentionally light sensitive.

By the expression "ortho to the hydroxy group" is meant covalently bonded to the carbon atoms immediately adjacent to the carbon atom to which the hydroxy group is covalently bonded.

A fatty acid is an organic monobasic acid of general formula $C_nH_{2n+1}COOH$ derived from the saturated series of aliphatic hydrocarbons, such as palmitic acid, stearic acid, behenic acid and arichidic acid.

Heating in a substantially water-free condition as used herein, means heating at a temperature of 80 to 250° C. The term "substantially water-free condition" means that the reaction system is approximately in equilibrium with water in the air, and water for inducing or promoting the reaction is not particularly or positively supplied from the exterior to the element. Such a condition is described in T. H. James, "The Theory of the Photographic Process", Fourth Edition, Macmillan 1977, page 374.

According to the present invention a substantially light-insensitive black and white thermographic recording material is provided comprising a support and a thermosensitive element exclusive of bisphenol compounds, 4-substitute isoxazole compounds of the formula

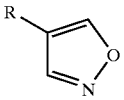

wherein R represents an aromatic group or an electron withdrawing group, organic compounds represented by $R^3$—H, the corresponding radical of which, $R^{3\bullet}$, has a stability of from 350 to 6000 times that of a primary alkyl radical, and photosensitive active-hydrogen aromatic organic reducing agents, the thermosensitive element containing at least one substantially light-insensitive organic silver salt, an organic reducing agent therefor in thermal working relationship therewith, an image tone stabilizer and a binder, characterized in that the image tone stabilizer is a sterically hindered monophenol.

According to a first aspect of the substantially light-insensitive thermographic recording material, according to the present invention, the sterically hindering groups in the sterically hindered monophenol are alkyl and cycloalkyl groups ortho to the hydroxy group.

According to a second aspect of the substantially light-insensitive thermographic recording material, according to the present invention, the sterically hindering groups in the sterically hindered monophenol ortho to the hydroxy group are selected from the group consisting of optionally substituted isopropyl, tertiary butyl, isobutyl, tertiary octyl, cyclopentyl and cyclohexyl groups.

According to a third aspect of the substantially light-insensitive thermographic recording material, according to the present invention, the sterically hindered monophenol has substituents other than the sterically hindering groups ortho to the hydroxy group selected from the group consisting of optionally substituted alkyl, cycloalkyl, alkoxy, aryloxy, carboxy and carboxyalkyl groups.

Suitable image tone stabilizing compounds according to the present invention are:

| Image tone stabilizer | | Structure |
|---|---|---|
| ITS-1 | 3,5-di-tert-butyl-4-hydroxybenzoic acid | 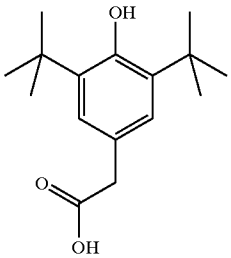 |
| ITS-2 | | 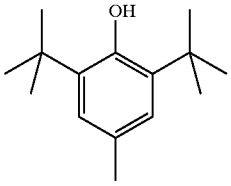 |
| ITS-3 | | 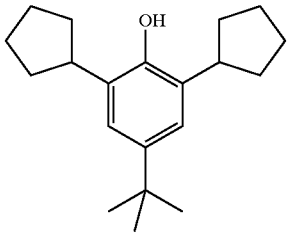 |
| ITS-4 | | 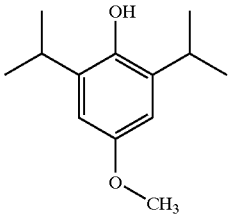 |
| ITS-5 | | 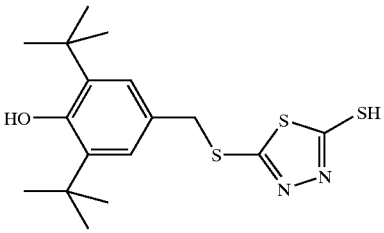 |
| ITS-6 | | 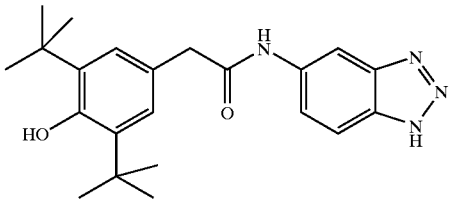 |

-continued

| Image tone stabilizer | Structure |
|---|---|
| ITS-7 | 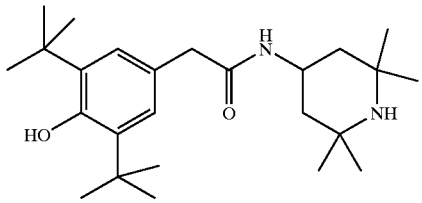 |
| ITS-8 | 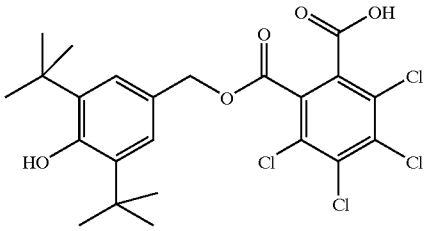 |
| ITS-9 | 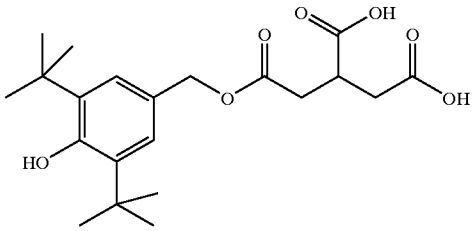 |
| ITS-10 | 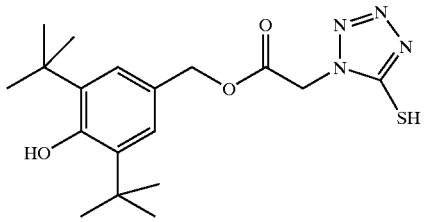 |
| ITS-11 | 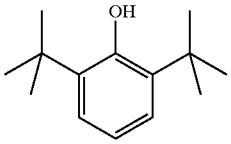 |
| ITS-12 | 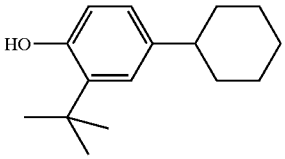 |

According to a fourth aspect of the substantially light-insensitive thermographic recording material, according to the present invention, the image tone stabilizer is 3,5-di-tert-butyl-4-hydroxybenzoic acid (ITS-1).

The thermosensitive element as used herein is that element which contains all the ingredients which contribute to image formation. According to the substantially light-insensitive thermographic recording material of the present invention the thermosensitive element is exclusive of bisphenol compounds, 4-substituted isoxazole compounds of the formula

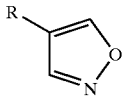

wherein R represents an aromatic group or an electron withdrawing group, organic compounds represented by $R^3$—H, the corresponding radical of which, $R^3$, has a stability of from 350 to 6000 times that of a primary alkyl radical, and photosensitive active-hydrogen aromatic organic reducing agents. The thermosensitive contains a substantially light-insensitive organic silver salt, an organic reducing agent therefor in thermal working relationship therewith, a sterically hindered phenol image tone stabilizer and a binder.

According to a fifth aspect of the substantially light-insensitive thermographic recording material, according to the present invention, the thermosensitive element is exclusive of 4-substituted isoxazole compounds.

According to a sixth aspect of the substantially light-insensitive thermographic recording material, according to the present invention, the thermosensitive element is exclusive of hydrogen atom donor compounds.

According to a seventh aspect of the substantially light-insensitive thermographic recording material, according to the present invention, the thermosensitive element is exclusive of hydrazide compounds.

According to a eighth aspect of the substantially light-insensitive thermographic recording material, according to the present invention, the thermosensitive element comprises a layer system in which the above-mentioned ingredients may be dispersed in different layers, with the proviso that the substantially light-insensitive organic silver salt is in reactive association with the reducing agent i.e. during the thermal development process the reducing agent must be present in such a way that it is able to diffuse to the particles of substantially light-insensitive organic silver salt so that reduction to silver can occur.

According to a ninth aspect of the substantially light-insensitive thermographic recording material, according to the present invention, the substantially light-insensitive organic silver salt is a substantially light-insensitive silver salt of an organic carboxylic acid.

According to a tenth aspect of the substantially light-insensitive thermographic recording material, according to the present invention, the substantially light-insensitive silver salt is a silver salt of an aliphatic carboxylic acid.

According to an eleventh aspect of the substantially light-insensitive thermographic recording material, according to the present invention, the substantially light-insensitive silver salt is a silver salt of a fatty acid.

According to a twelfth aspect of the substantially light-insensitive thermographic recording material, according to the present invention, the substantially light-insensitive silver salt is a silver salt of an aliphatic carboxylic acid, wherein the aliphatic carbon chain has between 12 and 30 C-atoms, e.g. silver laurate, silver palmitate, silver stearate, silver hydroxystearate, silver oleate and silver behenate, which silver salts are also called "silver soaps".

According to an thirteenth aspect of the substantially light-insensitive thermographic recording material, according to the present invention, the substantially light-insensitive silver salt is an organic carboxylic acid as described in GB-P 1,439,478, e.g. silver benzoate.

Combinations of different silver salts of an organic carboxylic acids may also be used in the present invention, as disclosed in EP-A 964 300, hereby incorporated by reference.

Organic silver salts may be dispersed by standard dispersion techniques e.g. using ball mills, bead mills, microfluidizers, ultrasonic apparatuses, rotor stator mixers etc. have been found to be useful in this regard. Mixtures of organic silver salt dispersions produced by different techniques may also be used to obtain the desired thermographic properties e.g. of coarser and a more finely ground dispersions of organic silver salts.

According to a fourteenth aspect of the substantially light-insensitive thermographic recording material, according to the present invention, the organic reducing agent for the reduction of the substantially light-insensitive organic silver salt is an organic compound containing at least one active hydrogen atom linked to O, N or C, such as is the case with, aromatic di- and tri-hydroxy compounds.

According to a fifteenth aspect of the substantially light-insensitive-thermographic recording material, according to the present invention, the organic reducing agent is a 1,2-dihydroxybenzene derivative, such as catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid ester.

According to an sixteenth aspect of the substantially light-insensitive thermographic recording material, according to the present invention, the organic reducing agent is an organic reducing agent disclosed in EP-B 692 733, herein incorporated by reference, e.g. ethyl 3,4-dihydroxybenzoate and n-butyl 3,4-dihydroxybenzoate.

According to a seventeenth aspect of the substantially light-insensitive thermographic recording material, according to the present invention, is an organic reducing agent disclosed in EP-A 903 625, herein incorporated by reference, e.g. 3,4-dihydroxybenzonitrile.

Combinations of reducing agents may also be used that on heating become reactive partners in the reduction of the substantially light-insensitive organic silver salt containing mixed crystals of two or more organic silver salts. For example, combinations of sterically hindered phenols with sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; and 2-substituted malonodialdehyde compounds as disclosed in U.S. Pat. No. 5,654,130.

According to an eighteenth aspect of the substantially light-insensitive thermographic recording material, according to the present invention, the binder is a natural, modified natural or synthetic resins or mixtures of such resins, in which the substantially light-insensitive organic silver salt can be homogeneously dispersed either in aqueous or solvent media: e.g. cellulose derivatives such as ethylcellulose, cellulose esters, e.g. cellulose nitrate, carboxymethylcellulose, starch ethers, galactomannan, polymers derived from α,β-ethylenically unsaturated compounds such as polyvinyl chloride, after-chlorinated polyvinyl chloride, copolymers of vinyl chloride and vinylidene chloride, copolymers of vinyl chloride and vinyl acetate, polyvinyl acetate and partially hydrolyzed polyvinyl acetate, polyvinyl alcohol, polyvinyl acetals that are made from polyvinyl alcohol as starting material in which only a part of the repeating vinyl alcohol units may have reacted with an aldehyde, preferably polyvinyl butyral, copolymers of acrylonitrile and acrylamide, polyacrylic acid esters, polymethacrylic acid esters, polystyrene and polyethylene or mixtures thereof.

According to a nineteenth aspect of the substantially light-insensitive thermographic recording material, according to the present invention, the binder is a water-soluble film-forming binder, for example: polyvinyl alcohol, polyacrylamide, polymethacrylamide, polyacrylic acid, polymethacrylic acid, polyvinylpyrrolidone, polyethyleneglycol, proteinaceous binders such as gelatine, modified gelatines such as phthaloyl gelatine, polysaccharides, such as starch, gum arabic and dextran and water-soluble cellulose derivatives.

According to a twentieth aspect of the substantially light-insensitive thermographic recording material, according to the present invention, the binder is gelatin.

According to a twenty-first aspect of the substantially light-insensitive thermographic recording material, according to the present invention, the weight ratio of binder to substantially light-insensitive organic silver salt is in the range of 0.2 to 7.

According to a twenty-second aspect of the substantially light-insensitive thermographic recording material, according to the present invention, the thickness of the thermosensitive element is in the range of 5 to 50 $\mu$m.

According to an twenty-third aspect of the substantially light-insensitive thermographic recording material, according to the present invention, the binder does not contain additives or impurities which adversely affect the thermographic properties of the substantially thermographic recording material.

According to a twenty-fourth aspect of the substantially light-insensitive thermographic recording material, according to the present invention, the thermosensitive element further contains a toning agent in order to obtain a neutral black image tone in the higher densities and neutral grey in the lower densities.

According to a twenty-fifth aspect of the substantially light-insensitive thermographic recording material, according to the present invention, the thermosensitive element further contains at least one toning agent selected from the group consisting of phthalimides and phthalazinones. Suitable toning agents are those within the scope of the general formulae described in U.S. Pat. No. 4,082,901. Further reference is made to the toning agents described in U.S. Pat. Nos. 3,074,809, 3,446,648 and 3,844,797.

According to a twenty-sixth aspect of the substantially light-insensitive thermographic recording material, according to the present invention, the thermosensitive element contains at least one heterocyclic toning compounds of the benzoxazine dione or naphthoxazine dione type as disclosed in GB 1,439,478, U.S. Pat. No. 3,951,660, e.g. benzo[e][1,3]oxazine-2,4-dione and 7-methyl-benzo[e][1,3]oxazine-2,4-dione, and U.S. Pat. No. 5,599,647, e.g. 7-(ethylcarbonato)-benzo[e][1,3]oxazine-2,4-dione, herein incorporated by reference.

According to a twenty-seventh aspect of the substantially light-insensitive thermographic recording material, according to the present invention, the substantially light-insensitive thermographic recording material further contains an antifoggant to obtain improved shelf-life and reduced fogging.

According to a twenty-eighth aspect of the substantially light-insensitive thermographic recording material, according to the present invention, the substantially light-insensitive thermographic recording material further contains at least one antifoggant selected from the group consisting of benzotriazole, substituted benzotriazoles, tetrazoles, mercaptotetrazoles such as 1-phenyl-5-mercaptotetrazole, and aromatic polycarboxylic acids such as orthophthalic acid, 3-nitro-phthalic acid, tetrachlorophthalic acid, mellitic acid, pyromellitic acid and trimellitic acid, and anhydrides thereof.

According to a twenty-ninth aspect of the substantially light-insensitive thermographic recording material, according to the present invention, the thermosensitive element further comprises at least one polycarboxylic acid and/or anhydride thereof in a molar percentage of at least 15 with respect to all the organic silver salt(s) present and in thermal working relationship therewith.

According to a thirtieth aspect of the substantially light-insensitive thermographic recording material, according to the present invention, the thermosensitive element further comprises at least one aliphatic (saturated as well as unsaturated aliphatic and also cycloaliphatic) or aromatic polycarboxylic acid, optionally substituted and optionally used in anhydride form or partially esterified form on the condition that at least two free carboxylic acids remain or are available in the heat recording step.

Surfactants and dispersants aid the dispersion of ingredients or reactants which are insoluble in the particular dispersion medium.

According to a thirty-first aspect of the substantially light-insensitive thermographic recording material, according to the present invention, the substantially light-insensitive thermographic recording material further comprises one or more surfactants, which may be anionic, non-ionic or cationic surfactants, and/or one or more dispersants.

The recording material may contain in addition to the ingredients mentioned above other additives such as antistatic agents, e.g. non-ionic antistatic agents including a fluorocarbon group as e.g. in $F_3C(CF_2)_6CONH(CH_2CH_2O)$—H, silicone oil, e.g. BAYSILON™ MA (from BAYER AG, GERMANY).

The support for the thermosensitive element according to the present invention may be transparent, translucent or opaque and is a thin flexible carrier made of transparent resin film, e.g. made of a cellulose ester, cellulose triacetate, polypropylene, polycarbonate or polyester, e.g. polyethylene terephthalate.

The support may be in sheet, ribbon or web form and subbed if need be to improve the adherence to the thereon coated thermosensitive element. It may be pigmented with a blue pigment as so-called blue-base. One or more backing layers may be provided to control physical properties such as curl and static.

According to a thirty-second aspect of the substantially light-insensitive thermographic recording material, according to the present invention, the thermosensitive element is provided with a protective layer to avoid local deformation of the thermosensitive element and to improve resistance against abrasion.

According to a thirty-third aspect of the substantially light-insensitive thermographic recording material, according to the present invention, the thermosensitive element is provided with a protective layer comprising a binder, which may be solvent-soluble, solvent-dispersible, water-soluble or water-dispersible.

According to a thirty-fourth aspect of the substantially light-insensitive thermographic recording material, according to the present invention, the thermosensitive element is provided with a protective layer comprising a solvent-soluble polycarbonate binder as described in EP-A 614 769, herein incorporated by reference.

According to a thirty-fifth aspect of the substantially light-insensitive thermographic recording material, according to the present invention, the thermosensitive element is provided with a protective layer comprising a water-soluble or water-dispersible binders, as coating can be performed from an aqueous composition and mixing of the protective layer with the immediate underlayer can be avoided by using a solvent-soluble or solvent-dispersible binder in the immediate underlayer.

According to a thirty-sixth aspect of the substantially light-insensitive thermographic recording material, according to the present invention, the thermosensitive element is provided with a crosslinked protective layer.

According to a thirty-seventh aspect of the substantially light-insensitive thermographic recording material, according to the present invention, the thermosensitive element is provided with a protective layer crosslinked with crosslinking agents such as described in WO 95/12495, herein incorporated by reference.

According to a thirty-eighth aspect of the substantially light-insensitive thermographic recording material, according to the present invention, the thermosensitive element is provided with a protective layer comprising solid or liquid lubricants or combinations thereof for improving the slip characteristics of the substantially light-insensitive thermographic recording material.

According to a thirty-ninth aspect of the substantially light-insensitive thermographic recording material, according to the present invention, the thermosensitive element is provided with a protective layer comprising thermomeltable particles as solid lubricants are thermomeltable particles, such as those described in WO 94/11199, herein incorporated by reference.

According to a fortieth aspect of the substantially light-insensitive thermographic recording material, according to the present invention, the thermosensitive element is provided with a protective layer comprising a matting agent, such as described in WO 94/11198, herein incorporated by reference, e.g. talc particles, which optionally protrude from the protective layer.

The coating of any layer of the recording material of the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A.

Thermographic imaging is carried out by the image-wise application of heat either in analogue fashion by direct exposure through an image or by reflection from an image, or in digital fashion pixel by pixel either by using an infra-red heat source, for example with a Nd-YAG laser or other infra-red laser, with a substantially light-insensitive thermographic material preferably containing an infra-red absorbing compound, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

In order to avoid direct contact of the thermal printing heads with the outermost layer on the same side of the support as the thermosensitive element when this outermost layer is not a protective layer, the image-wise heating of the recording material with the thermal printing heads may proceed through a contacting but removable resin sheet or web wherefrom during the heating no transfer of recording material can take place.

Activation of the heating elements can be power-modulated or pulse-length modulated at constant power. EP-A 654 355 discloses a method for making an image by image-wise heating by means of a thermal head having energizable heating elements, wherein the activation of the heating elements is executed duty cycled pulsewise. EP-A 622 217 discloses a method for making an image using a direct thermal imaging element producing improvements in continuous tone reproduction.

Image-wise heating of the recording material can also be carried out using an electrically resistive ribbon incorporated into the material. Image- or pattern-wise heating of the recording material may also proceed by means of pixel-wise modulated ultra-sound.

Thermographic imaging can be used for the production of reflection type prints and transparencies, in particular for use in the medical diagnostic field in which black-imaged transparencies are widely used in inspection techniques operating with a light box.

The invention is illustrated hereinafter by way of comparative examples and invention examples. The percentages and ratios given in these examples are by weight unless otherwise indicated. The ingredients used in the invention and comparative examples, are:

organic silver salts:
- AgB=silver behenate;

the reducing agent:
- R01=ethyl 3,4-dihydroxybenzoate;
- R02=3,4-dihydroxybenzonitrile;

the binders:
- K17881=type 17881, a gelatin with low potassium ion, sodium ion and chloride-ion concentrations from AGFA-GEVAERT GELATINEFABRIEK vorm. KOEPFF & SÖHNE;
- R16875=type 16875, a phthaloyl-gelatin from Rousselot;
- LATEX01=a copolymer consisting of 54.25 wt. % styrene, 43.25 wt. % butyl acrylate and 2.5 wt. % potassium salt of N-[(4'-sulfobenzamido)-oxo-decyl] methacrylamide;

S01=1-phenyl-5-mercapto-tetrazole;

toning agents:
- T01=7-(ethylcarbonato)-benzo [e][1,3]oxazine-2,4-dione;
- T02=phthalazinone.

Surfactant No. 1=MARLON™ A-365, supplied as a 65% concentrate of a sodium alkyl-phenylsulfonate by HÜLS;

Surfactant No. 2=MARLON™ AS3, supplied as a 98% concentrate of an alkylphenylsulfonic acid by HÜLS.

The following examples further illustrate the invention but, of course, should not be construed as in any way limiting its scope.

COMPARATIVE EXAMPLES 1 to 4 and INVENTION EXAMPLES 1 to 3

Preparation of Silver Behenate Dispersions

The silver behenate dispersion was produced as follows: 25 kg (73.5M) behenic acid was dispersed with stirring at 80° C. in 100L of a 10% solution of Surfactant No. 1 per g behenic acid made up to 250L with deionized water at a temperature of 80° C.; then 36.75L of a 2M aqueous solution of sodium hydroxide was added over a period of 10 to 20 minutes to give a clear solution substantially containing sodium behenate; then 25L of a 2.94M aqueous solution of silver nitrate was added with stirring at a rate of 0.163 moles/moles silver behenate min to convert the sodium behenate completely into silver behenate; and finally ultrafiltration was carried out with a 500000 MW polysulfone cartridge filter at room temperature to concentrate the resulting silver behenate dispersion while adding ammonium nitrate to convert Surfactant No. 1 into its ammonium salt, the final AgBeh-concentration was 20.4% with 0.062 g of ammonium alkyl-phenylsulfonate/g AgBeh, the residual conductivity was 1.0 mS/cm.

Preparation of Thermographic Recording Materials

The coating dispersion for the thermosensitive element was produced by first allowing 3.44 g of K17881 to swell in 16.33 g of deionized water over a period of 30 minutes. 3.05 g of a first aqueous toning agent dispersion containing 18.08% of T01 and 9.95% of K17881 and 0.8 g of a second toning agent dispersion containing 20.12% of T02 and 8.88% of R16875 were then added and the resulting dispersion heated with stirring up to 50° C. 2 g of the above-mentioned dispersion of silver behenate were then added and after 10 minutes stirring a further 22.2 g of the same silver behenate dispersion were added and the resulting dispersion stirred for a further 10 minutes before 3.955 g of a 25.28% dispersion of LATEX01 was added. After a further 10 minutes stirring 2.222 g of 5.9% polyitaconic acid in water was added and after a further 10 minutes stirring, the resulting dispersion was cooled to 36° C. Finally 18 g of deionized water was added in the case of COMPARATIVE EXAMPLE 1 or quantities or solutions or dispersions of the different stabilizers according to U.S. Pat. No. 5,672,560 and the image stabilizing agents according to the present invention to produce a concentration of 10 mol % with respect to silver behenate made up to 18 g with deionized water were added in the case INVENTION EXAMPLE 1 (see Table 1 for method of addition) and the dispersion stirred for a further 15 minutes. Shortly before coating 6 g of an aqueous ethanol solution containing 9.909% of R02 and 4.9% of S01 was added with stirring.

This coating dispersion at a temperature of 36° C. was then doctor-blade coated onto the non-backing layer side of a subbed 168 μm thick blue-pigmented polyethylene terephthalate support with a backing layer (optical density upon measurement with a MACBETH™ TR924 densitometer through visible and blue filters in transmission of subbed support with backing layer was 0.19 and 0.05 respectively) to a wet coating weight of 72 g/m$^2$ and while undried was overcoated with 11 g/m$^2$ of an aqueous solution with 1.8% by weight of 1,1-bis(vinylsulfono)methane and 0.9091% by weight of Surfactant No. 1. Upon drying, the thermosensitive elements of COMPARATIVE EXAMPLE 1 and INVENTION EXAMPLE 1 were obtained.

TABLE 1

| | AgB | Image tone stabilizer | | |
|---|---|---|---|---|
| | g/m$^2$ | type | mol % vs AgB | Added as |
| Comparative Example No. 1 | 4.847 | — | — | — |
| Invention Example No. 1 | 5.163 | ITS-1 | 10 | 2.6% solution in aqueous ethanol (75 vol % ethanol) |

Thermographic Printing

During the thermographic printing of the substantially light-insensitive thermographic recording materials of COMPARATIVE EXAMPLE 1 and INVENTION EXAMPLE 1, the print head was separated from the imaging layer by a thin intermediate material contacted with a slipping layer of a separable 5 μm thick polyethylene terephthalate ribbon coated successively with a subbing layer, heat-resistant layer and the slipping layer (anti-friction layer) giving a ribbon with a total thickness of 6 μm.

The DRYSTAR™ 2000 printer from AGFA-GEVAERT was equipped with a thin film thermal head with a resolution of 300 dpi and was operated with a line time of 11.8 ms (the line time being the time needed for printing one line). During this line time the print head received constant power. The printing power was 90 mW and the thermal head resistors were time-modulated to produce different image densities.

The maximum densities of the images ($D_{max}$) measured through a visible filter with a MACBETH™ TR924 densitometer in the grey scale step corresponding to a data level of 64 are given in Table 2.

Image Evaluation

The image tone of fresh prints made with the substantially light-insensitive thermographic recording materials of COMPARATIVE EXAMPLE 1 and INVENTION EXAMPLE 1 was assessed on the basis of the L*, a* and b* CIELAB-values. The L*, a* and b* CIELAB-values were determined by spectrophotometric measurements according to ASTM Norm E179-90 in a R(45/0) geometry with evaluation according to ASTM Norm E308-90. The a* and b* CIELAB-values of fresh prints of the substantially light-insensitive thermographic recording materials of COMPARATIVE EXAMPLE 1 and INVENTION EXAMPLE 1 at optical densities, D, of 1.0 are also given in Table 2.

TABLE 2

| | AgB | Image tone | Print with fresh material | | CIELAB-values for print with fresh material for D = 1 | |
|---|---|---|---|---|---|---|
| | | | $D_{max}$ | $D_{min}$ | | |
| | g/m$^2$ | stabilizer | vis | vis | a* | b* |
| Comparative Example No. 1 | 4.847 | — | 3.30 | 0.21 | −3.11 | −4.37 |
| Invention Example No. 1 | 5.163 | ITS-1 | 3.33 | 0.21 | −3.45 | −4.54 |

The $D_{min}$ values are mainly due to the density of the support, which had a $D_{vis}$ value of 0.19.

Shelf-Life Tests

Simulated long-term shelf-life tests were performed by heating fresh thermographic recording materials of COMPARATIVE EXAMPLE 1 and INVENTION EXAMPLE 1 at 45° C. in 70% relative humidity in the dark for 3 and 7 days respectively before printing. Prints with these materials were evaluated as described above for prints of the corresponding fresh thermographic recording materials and the results are given in Table 3 and Table 4 respectively.

TABLE 3

| | Image tone stabilizer | Print of material after 3d/45° C./70% RH | | CIELAB-values of material printed after 3d/45° C./70% RH for D = 1 | | ΔCIELAB-values versus printing of fresh material for D = 1 | |
|---|---|---|---|---|---|---|---|
| | | $D_{max}$ | $D_{min}$ | | | | |
| | | vis | Vis | a* | b* | Δa* | Δb* |
| Comparative Example No. 1 | — | 4.04 | 0.20 | −4.81 | −0.17 | −1.70 | +4.20 |
| Invention Example No. 1 | ITS-1 | 3.99 | 0.20 | −4.68 | −1.25 | −1.23 | +3.29 |

In the CIELAB-system a negative CIELAB a*-value indicates a greenish image-tone becoming greener as a* becomes more negative, a positive a*-value indicating a reddish image-tone becoming redder as a* becomes more positive. A negative CIELAB b*-value indicates a bluish tone which becomes increasingly bluer as b* becomes more negative and a positive b*-value indicates a yellowish image-tone becoming more yellow as b* becomes more positive. In terms of the visual perception of an image as a whole, the image tone of elements of the image with a density of 1.0 have a stronger effect than the image tone of elements with lower or higher optical density.

Shelf-life performance was evaluated by comparing the change in a* and b* CIELAB values between prints produced with a sheet of the thermographic recording material subjected to heating in the dark for 3 days at 45° C. and 70% relative humidity and a sheet which has been subjected to heating in the dark for a further 4 days at 45° C. and 70% relative humidity i.e. 7 days in all at 45° C. and 70% relative humidity. More acceptable shelf-life behavior is represented by lower shifts in a* and b* CIELAB values at D=1.

Prints produced with the thermographic recording materials of INVENTION EXAMPLE 1 after 3 days at 45° C. and 70% relative humidity have a CIELAB b* value which is more blue at a density of 1.0 i.e. b* is negative and closer to the desired level for b* of −8.8, as can be seen from Table 3 above.

This difference is more pronounced for prints produced with the thermographic recording materials after a further 4 days at 45° C. and 70% relative humidity, making 7 days in all, as can be seen from Table 4 below.

TABLE 4

| | Image tone stabilizer | Print of material after 7d 45° C./70% RH $D_{max}$ vis | $D_{min}$ vis | CIELAB-values for print of material after 7d at 45° C./70% RH for D = 1 a* | b* | ΔCIELAB-values versus material printed after 3d at 45° C./70% RH for D = 1 Δa* | Δb* |
|---|---|---|---|---|---|---|---|
| Comparative Example No. | | | | | | | |
| 1 | — | 4.00 | 0.20 | −7.5 | +0.75 | −2.69 | +0.92 |
| Invention Example No. | | | | | | | |
| 1 | ITS-1 | 4.41 | 0.22 | −6.77 | −0.41 | −2.09 | +0.84 |

In conclusion substantially light-insensitive thermographic recording materials incorporating sterically hindered monophenols as image tone stabilizing compounds exhibit an improved shelf-life image tone stability over substantially light-insensitive thermographic recording materials without sterically hindered monophenols.

Having described in detail preferred embodiments of the current invention, it will now be apparent to those skilled in the art that numerous modifications can be made therein without departing from the scope of the invention as defined in the following claims.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Of course, variations of those preferred embodiments will become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A substantially light-insensitive black and white thermographic recording material comprising a support and a thermosensitive element, wherein said thermosensitive element is exclusive of bisphenol compounds, 4-substituted isoxazole compounds of the formula:

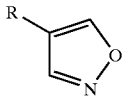

wherein R represents an aromatic group or an electron withdrawing group, organic compounds represented by $R^3$-H, the corresponding radical of which, $R^{3\bullet}$, has a stability of from 350 to 6000 times that of a primary alkyl radical, and photosensitive active-hydrogen aromatic organic reducing agents, and said thermosensitive element contains at least one substantially light-insensitive organic silver salt, an organic reducing agent therefor in thermal working relationship therewith, an image tone stabilizer and a binder, characterized in that wherein said image tone stabilizer is a sterically hindered monophenol.

2. Thermographic recording material according to claim 1, wherein said thermosensitive element further contains a toning agent.

3. Thermographic recording material according to claim 2, wherein said toning agent is phthalazinone, a phthalazinone derivative, pyridazone, a pyridazone derivative, a benzoxazine derivative or a substituted benzoxazine derivative.

4. Thermographic recording material according to claim 1, wherein said stabilizer compound is 3,5-di-tert-butyl-4-hydroxybenzoic acid.

5. A recording process comprising the steps of: (i) bringing an outermost layer of a thermographic recording material according to claim 1 into proximity with a heat source; (ii) applying heat from said heat source imagewise to said thermographic recording material in a substantially water-free condition while maintaining proximity to said heat source to produce an image; and (iii) removing said thermographic cording material from said heat source.

6. Recording process according to claim 5, where n said heat source is a thin film thermal head.

7. Process for preparing a substantially light-insensitive thermographic recording material comprising a sterically hindered monophenol as an image tone stabilizer; comprising the steps of: providing said substantially light-insensitive thermographic recording material comprising a support and a thermosensitive element, said thermosensitive element containing at least one substantially light-insensitive organic silver salt, an organic reducing agent therefor in thermal working relationship therewith, the sterically hindered monophenol and a binder: and imagewise-applying heat to said substantially light-insensitive thermographic material.

8. Thermographic recording material according to claim 2, wherein said stabilizer compound is 3,5-di-tert-butyl-4-hydroxybenzoic acid.

9. Thermographic recording material according to claim 3, wherein said stabilizer compound is 3,5-di-tert-butyl-4-hydroxybenzoic acid.

* * * * *